US007503800B2

(12) United States Patent
Siglock et al.

(10) Patent No.: US 7,503,800 B2
(45) Date of Patent: Mar. 17, 2009

(54) METER JAW ASSEMBLY

(76) Inventors: John V. Siglock, 4029 N. Bennington Ave., #104, Kansas City, MO (US) 64155; Shawn J. Glasgow, 4801 Deramus Ave., Kansas City, MO (US) 64120

( * ) Notice: Subject to any disclaimer, the term of this patent is extended or adjusted under 35 U.S.C. 154(b) by 0 days.

(21) Appl. No.: 11/849,708

(22) Filed: Sep. 4, 2007

(65) Prior Publication Data

US 2008/0057797 A1 Mar. 6, 2008

Related U.S. Application Data

(60) Provisional application No. 60/842,125, filed on Sep. 1, 2006.

(51) Int. Cl.
*H01R 33/945* (2006.01)

(52) U.S. Cl. ..... 439/517

(58) Field of Classification Search ..... 439/517, 439/801–804; 361/659, 664, 668, 669
See application file for complete search history.

(56) References Cited

U.S. PATENT DOCUMENTS

| | | | |
|---|---|---|---|
| 3,281,550 | A | 10/1966 | Waldrop |
| 4,104,588 | A | 8/1978 | Westberry |
| 4,201,439 | A | 5/1980 | M'Sadoques |
| 5,595,316 | A | 1/1997 | Gallarelli et al. |
| 5,870,276 | A | 2/1999 | Leach et al. |
| 6,561,844 | B1 | 5/2003 | Johnson |
| 2005/0227532 | A1 | 10/2005 | Kellerman |

*Primary Examiner*—Khiem Nguyen
(74) *Attorney, Agent, or Firm*—Shughart Thomson & Kilroy PC; Dennis A. Crawford

(57) ABSTRACT

An improved meter jaw assembly includes a one-piece meter jaw member formed by extrusion and including a pair of resilient jaw contacts extending from a base tab which also has a U-shaped wire receiver extending therefrom. Inner surfaces of the receiver are grooved to receive a slide nut with a threaded slide screw to clamp the end of a power cable therein. The jaw members include mounting keys to secure them to a mounting block. In a mold-in embodiment of the assembly, a pair of jaw members have mounting keys molded into the mounting block. In a slide-in embodiment, a pair of jaw members are retained in slide-in channels within the mounting block.

20 Claims, 8 Drawing Sheets

METER JAW ASSEMBLY

CROSS-REFERENCE TO RELATED APPLICATION

This application claims priority under 35 U.S.C. 119(e) and 37 C.F.R. 1.78(a)(4) based upon U.S. Provisional Application, Ser. No. 60/842,125 for AN IMPROVED METER JAW ASSEMBLY, filed Sep. 1, 2006, which is incorporated herein by reference.

BACKGROUND OF THE INVENTION

The present invention relates generally to contact assemblies, and more particularly, to a one-piece meter jaw and to meter socket assemblies incorporating such jaws, such as for use in a socket for a direct-reading watt-hour meter. This type of socket is known in the trade as an "S" type meter socket. It has a standardized form to allow the interchangeability of meters from various manufacturers without removing any wires or cables. A watt-hour meter having a typical pattern of a pair of parallel sets of aligned connector blades is shown in U.S. Pat. No. 4,104,588, which is incorporated herein by reference. While such a meter socket is employed for meters capable of continuous full load currents of 20 to 400 amperes, it is most typically utilized for residential applications at 200 amperes.

In standard plug-in "S" type meter sockets, a watt-hour meter is plugged into a meter socket which is mounted in an enclosure. This configuration must provide means to make the electrical connection to the incoming and outgoing power cables or bus bars. In this type of meter socket, the electrical connections to the meter, as well as the retention of the meter in the meter socket, is performed solely by a plurality of meter jaws. These jaws are electrically connected to means for electrical connection to the power cables or bus bars. Because these jaws and connectors are all connected to separate electrical potentials, they must be fixedly supported by one or more insulating mounting bases or blocks, which are in turn secured to the enclosure.

In one known configuration, the meter jaws are constructed of flat metal that is formed to create a conductive receiving jaw in such a manner that there is a resulting compressive force which is required to retain the meter blades in the jaws. The compressive force must be sufficient to reduce the heating that will occur as current is passed through the watt-hour meter, but must be low enough to permit installation of the meter into the meter socket and removal of the meter therefrom. Some specifications require that the force required to insert the meter, which may have from 4 to 7 meter connections, into the meter socket be less than 100 pounds. The selection of materials for such jaws is a compromise. The metal must have high electrical conductivity to reduce the resistive heating effects and high thermal conductivity to permit conduction of the heat out of the meter sockets through the power cables. It must also be relatively short and thick to lower its bulk resistance to minimize the heating effects. On the other hand, the mechanical form of the meter jaw must be such that the yield strength of the material is not exceeded as the meter blade is engaged to such an extent that the jaw does not substantially return to its initial geometry when the meter blade is retracted or an additional supplemental spring component would be required. In order to insure these mechanical characteristics, the mechanical form of the jaw should be relatively long and thin in cross-section. The conductive element is often chosen to be a bronze, brass, beryllium-copper, or other alloy rather than copper or aluminum, which are more electrically and thermally conductive.

Because of these trade-off characteristics, many meter jaw designs employ additional separate components which function as springs to supplement the compressive forces provided by the electrically conductive elements of the meter jaws. Additional components are also used to guide the meter into the jaws and to electrically and/or mechanically connect the meter jaw, electrical connector, mounting base and enclosure.

FIG. 1 shows a typical modern meter socket jaw assembly 200 for use with power cables. There are typically four of these assemblies in a meter socket, although there may be as many as six current-carrying jaws in an "S" type socket. A wire connector 202 is electrically and thermally coupled to meter jaw 204 by a stud 206 and meter guide/jaw nut 208. A slide nut 210 engages a pair of receiving grooves 214 in the connector 202, and slide screw 216 acts to force stranded wire placed in connector 202 into good mechanical, electrical and thermal contact with connector 202. A back-up spring 218 is optionally used to improve contact force and lower joint resistance with the meter socket. It is located inside the meter jaw 204 by a hole that cooperates with the stud 206. Note that there are 7 or 8 components per conductor, or at least 28 such components in a 4 terminal meter socket. A securing nut 220 is used to retain the assembly 200 to a mounting block 226 in FIG. 2.

FIG. 2 shows additional components that are required. These are used to insulate the electrical components from an enclosure 228 (FIG. 3) which will house the meter jaw assemblies 200, to secure the components to the enclosure 228, and to provide the required grounding connection (not shown) to the watt-hour meter. The insulative mounting blocks 226 receive the assemblies 200 described in FIG. 1. Wire meter supports 230 are located by mating bosses and grooves in the mounting block 226. The mounting blocks 226 are then secured to a mounting bridge 232 by the four mountings screws 234. The mounting bridge 232 with all components installed is secured to the enclosure 228 by mounting screws 236. In typical meter sockets, these represent an additional 11 components. In some applications three of these components are not required (mounting bridge 232 and 2 mounting screws 236).

FIG. 3 shows the remaining components of a typical modern meter socket. They include the enclosure 228 and a cover 240. The cover 240 has latch 242 rotationally fixed by rivet 244 to cooperate with a tab in enclosure 228 to seal the enclosure. The cover 240 has a flange 246 surrounding an opening through which a cylindrical, glass covered portion of the watt-hour meter extends. The cover flange 246 engages a corresponding flange on the meter when the cover 240 is latched to thereby retain the meter against the wire support 230.

The prior art meter socket described above has several disadvantages. Firstly, the use of a high number of components acts to reduce reliability. Secondly, the high number of components acts to increase assembly costs. Yet another disadvantage of the current art is the temperature rise permitted. Agencies such as Underwriters Laboratories specify temperature rise limits for meter sockets and their components. A limit is specified for the connector to insure that connecting cable insulation or bus bars are not damaged or degraded. A 10 degree Centigrade higher limit is imposed on the meter jaw to insure that watt-hour meters are not degraded or damaged. Most current art meters exhibit this 10 degree difference. It is the result of the geometry of the meter jaw and its electrical and thermal conductivity. Many modern watt-hour meters employ semiconductor electronic components. These and other electronic components exhibit reduced life phenomena at increased temperatures.

SUMMARY OF THE INVENTION

The present invention provides greatly improved watt-hour meter socket components and assemblies thereof which reduce the number of components required for each meter jaw in a meter socket, which reduce the number of manufacturing operations required to manufacture the electrical connector used in each meter jaw, which reduce the heat generated in each meter jaw in a meter socket, and which minimize the thermal gradient from the meter jaw to the power connection.

The meter socket assemblies of the present invention generally include one piece meter jaw members for receiving connector blades of watt-hour meters and are generally formed of a base tab, a pair of resilient meter jaw contacts extending from the base tab and having outer curved sections mutually curved toward one another and positioned in mutually spaced relation to form a meter connector blade receiving space between the outer curved sections. The jaw contacts have such geometric configurations and material characteristics as to exert a selected force on a meter connector blade having a standard industry specified thickness when received in the blade receiving space. Additionally, an electrical power connector extends from the base tab and is configured to receive a power cable, a bus bar, a bus bar connector, or the like.

More specifically, the meter jaw contacts are generally S-shaped and extend from the base tab in mutually spaced, back-to-back relation therefrom. In one embodiment of the meter jaws, the electrical power connector is formed by a U-shaped conductor having spaced apart legs connected by a curved bight section and sized to received to receive an electric power cable. Slide nut grooves are formed into opposite internal surfaces of the legs to receive a slide nut having a slide screw threaded therein for clamping a stripped end of the electric power cable between the slide nut and the U-shaped conductor. The meter jaw may include a meter jaw mounting key extending from the base tab for use in mounting the meter jaw member on an insulative meter jaw mounting block to form a half of a watt-hour meter socket assembly for mounting into a meter socket enclosure.

In a mold-in embodiment of the meter jaw assembly, the meter jaw mounting key is a mold-in mounting key, formed by a key web extending from the base tab with a plurality of key flanges extending from opposite sides of the key web to form substantially serrated surfaces on the opposite sides of the key web. A pair of the mold-in meter jaw members are positioned in spaced relation within a mounting block mold with the mold-in mounting key extending into the mounting block mold cavity. The meter jaw members are properly positioned and oriented to align the meter blade receiving spaces. A resin in a plastic state is injected into the mold cavity and allowed to solidify or cure whereby parts of the pair of meter jaw members are molded into the mounting block to simplify forming a meter socket assembly half.

In a slide-in embodiment of the meter jaw assembly, a slide-in meter jaw mounting key is formed by a key web extending from the base tab and terminating in a key flange spaced from the base tab. An insulative meter jaw mounting block is formed with a pair of aligned key retainer channels which receive the key flanges to position a pair of meter jaw members in aligned and spaced relation on the mounting block. A meter jaw retainer member is secured to the mounting block to retain the meter jaw members in place within the slide-in meter jaw assembly. The slide-in embodiment of the meter jaw assembly has a few more parts than the mold-in embodiment and requires more assembly steps. However, the slide-in embodiment significantly reduces the parts count and assembly steps required to form a meter socket assembly.

Various objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 3:
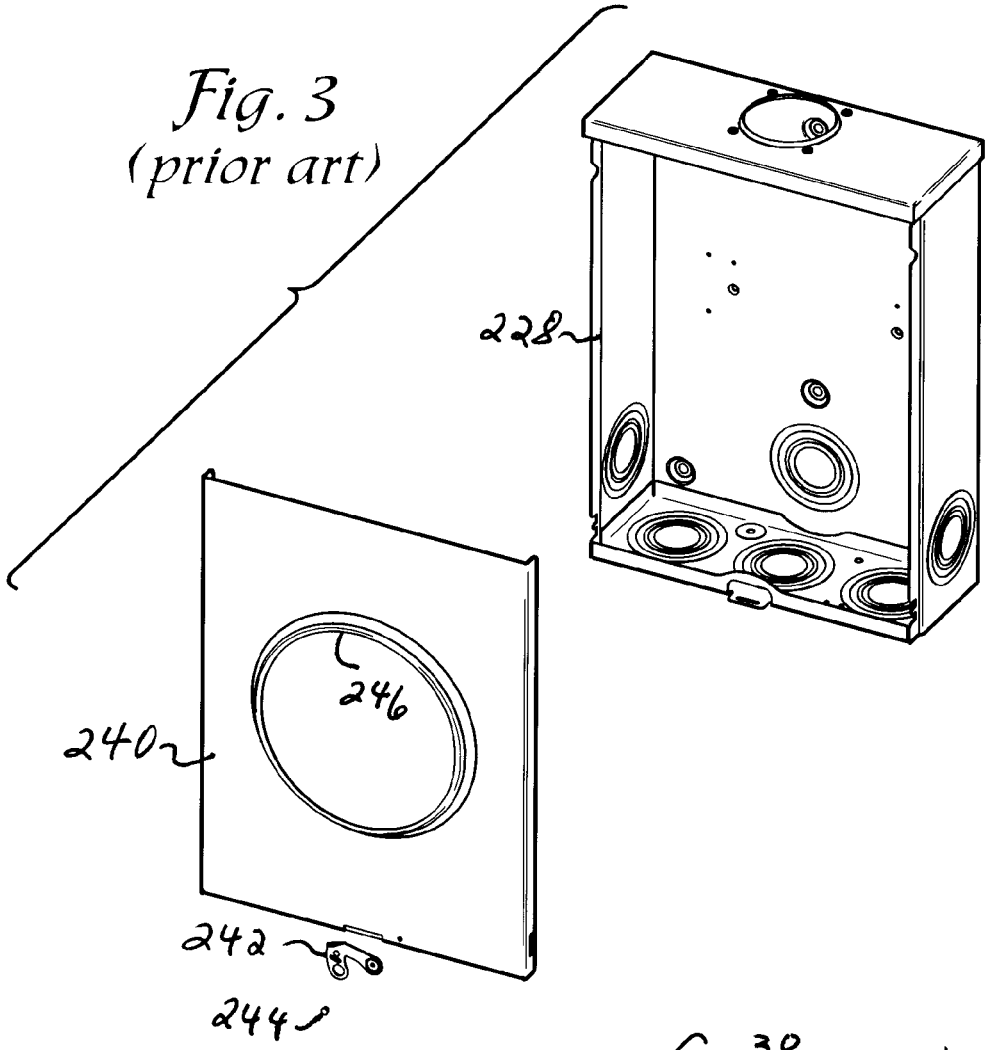
Fig. 3 (prior art)
FIG. 3 is an exploded perspective view at a reduced scale of a prior art power meter socket enclosure.
Figure 4:
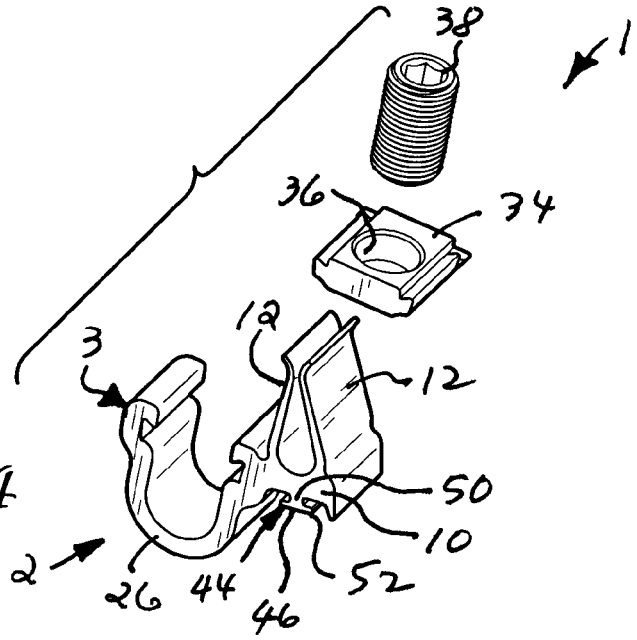
FIG. 4 is an exploded perspective view of a slide-in embodiment of a meter socket jaw assembly according to the present invention.
Figure 5:
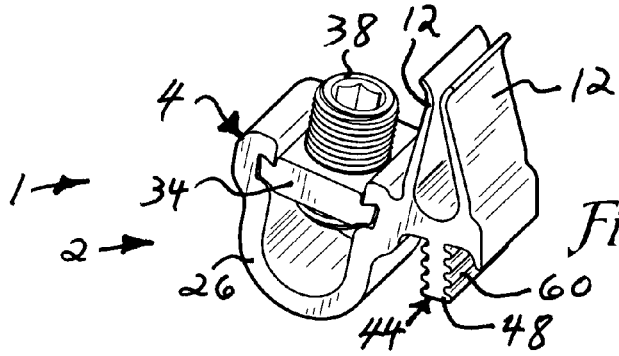
FIG. 5 is a perspective view of an assembled mold-in embodiment of a meter socket jaw assembly according to the present invention.

Referring drawings in more detail, the reference numeral 1 generally designates an improved watt-hour meter jaw assembly according to the present invention. Sets of the jaw assemblies 1 are used to receive corresponding sets of connector blades (not shown) of electrical power industry standard configurations of watt-hour meters. The meter jaw assemblies 1 may include one of two principal embodiments of meter jaw members 2, including a slide-in meter jaw member 3 (FIG. 4) or a mold-in meter jaw member 4 (FIG. 5). The meter jaw members 3 and 4 are secured to corresponding insulative meter jaw mounting blocks 6 (FIG. 9) or 7 (FIG. 11) for mounting within a meter socket enclosure 228 (FIG. 3).

The slide-in and mold-in meter jaw members 3 and 4 have a number of elements in common and will be described generally with reference to FIG. 8. Each meter jaw member 2 includes a base tab 10 with a pair of resilient meter jaw contacts 12 extending therefrom. The illustrated meter jaw contacts 12 are roughly back-to-back S-shaped elements and are generally mirror images of one another. Outer curved regions 14 of the contacts 12 curve toward one another to define a watt-hour meter blade receiving space 16 therebetween. Outer ends 18 of the contacts 12 flare from the curved regions 14 to form a guide for a meter blades into the blade receiving space 16. It should be noted that the jaw contacts 12 taper in thickness from root ends 20 at the base tab 10 toward the outer ends 18. The contour of the taper of the jaw contacts 12 is a factor in determining the resilience or spring constant of the jaw contacts 12.

Various embodiments of the meter jaw members 2 generally function to connect a first conductor, such as a meter blade or a bus bar (not shown), to a second conductor, such as a service power cable, a bus bar, or the like. The illustrated meter jaw members 3 and 4 each include an electrical power cable connector or wire receiver 26 to provide for connection of an electrical supply cable from an electrical utility or a service cable, such as for a home or commercial building, to conductor blades of a watt-hour meter. The illustrated cable connector 26 is U-shaped and includes a pair of spaced apart, generally parallel legs 28 and 29 connected by a curved bight section 30. An inner leg 29 extends from the base tab 10. The illustrated legs 28 and 29 include slide nut grooves or slots 32 formed into their inner surfaces to receive a slide nut 34. The slide nut 34 has a threaded aperture 36 (FIG. 4) to receive a threaded slide screw 38, which is illustrated as an Allen type screw. The slide nut 34 and slide screw 38 cooperate with the power cable connector 26 to clamp a stripped end of a power cable (not shown) against the bight section 30 of the connector 26. The power cable connector 26, slide nut 34, and slide screw 38 are similar in configuration and function to corresponding elements of the wire connector 202 shown in FIG. 1.

The jaw contacts 12 are configured to exert a selected compressive force on a watt-hour meter blade or stab to optimize electrical and thermal contact therewith. The force exerted is determined by the constituent material and the geometric dimensions. These factors also determine the electrical conductivity between areas of contact of the jaw contacts 12 with the meter blade and the area of contact between the wire receiver 26 and a power cable. Although not shown, the jaw members 2 may have a jumper blade extending from an outer end of the outer leg 28 of the wire receiver 26 to receive a jumper to interconnect jaw members 2 of a mounting block when the meter is to be removed.

The meter jaw members 2 may include a mounting element or key 44 for securing it to a fixed support. The slide-in meter jaw member 3 includes a slide-in mounting key 46 while the mold-in meter jaw member 4 includes a mold-in mounting key 48. The illustrated slide-in mounting key 46 includes a key web 50 (FIG. 10) extending from the base tab 10 and terminating in a key flange 52 extending from opposite sides thereof. Similarly, the mold-in mounting key 48 includes a key web 56 (FIG. 8) extending from the base tab 10 and having a plurality of key flanges 58 extending from opposite sides thereof to provide opposite grip surfaces 60 of the mold-in key 48 with a serrated or "corduroy" effect. The grip surfaces 60 of the mold-in key 48 could, alternatively, be provided with outer surface configurations or finishes for enhanced gripping, such as a pebble grain, bumps, knurling, swaging, or the like.

Figure 6A:
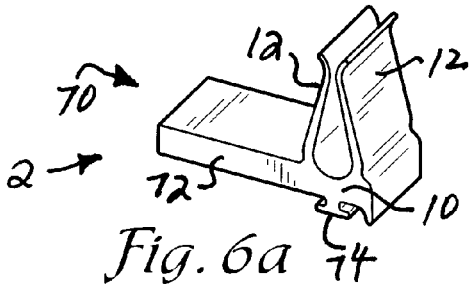
FIGS. 6*a*-6*f* are perspective views of a plurality of alternative embodiments of jaws for watt-hour meters and bus bars according to the present invention.
Figure 6B:
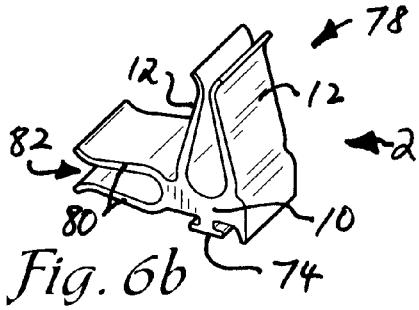

FIGS. 6*a*-6*f* illustrate alternative embodiments of the meter jaw members 2 and bus bar connectors 66 (FIGS. 6*d* and 6*e*) which are considered to be encompassed by the present invention. FIG. 6*a* shows a meter jaw member 70 with an integral bus bar or tab 72 extending from a base tab 10, which also has resilient meter jaw contacts 12 extending therefrom The bar 72 may be punched or drilled and joined to other bus bars using fasteners. The jaw member 70 also has a slide-in mounting key 74 extending from the base tab 10. A meter jaw member 78 in FIG. 6*b* includes a pair of resilient meter jaw contacts 12 extending from a base tab 10 along with a pair of resilient bus bar jaw contacts 80 extending from the base tab 10 at a substantially right angle to the meter jaw contacts 12. The bus bar jaw contacts 80 are substantially similar to the meter jaw contacts 12 except that a bus bar receiving space 82 therebetween is wider than the blade receiving space 16 of the jaw contacts 12 of the jaw members 2. The jaw contacts 80 enable the jaw member 78 to be connected to a bus bar without the use of fasteners. The illustrated jaw member 78 includes a slide-in mounting key 74 extending from the base tab 10.

Figure 6C:
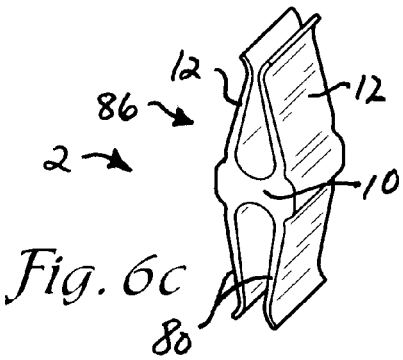
Figure 6D:
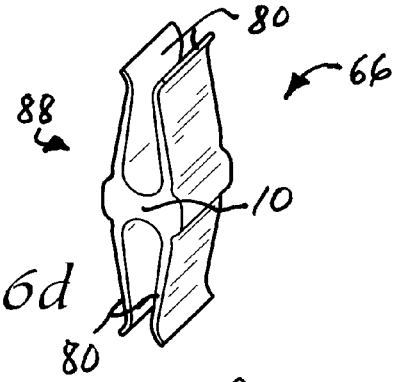
Figure 6E:
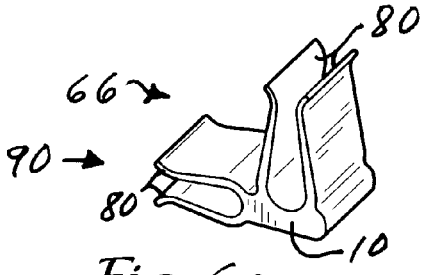
Figure 6F:
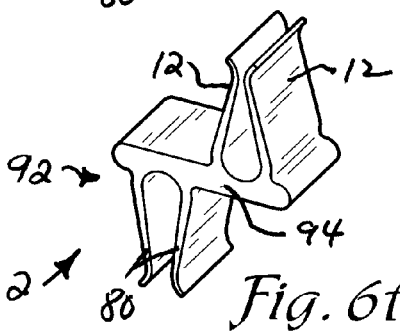

FIG. 6*c* shows an in-line meter jaw member 86 including a pair of resilient meter jaw contacts 12 extending from one side of a base tab 10 and a pair of bus bar jaw contacts 80 extending from an opposite side of the base tab 10. FIG. 6*d* shows an in-line bus bar connector 88 having pairs of resilient bus bar jaw contacts 80 extending from opposite sides of a base tab 10. FIG. 6*e* illustrates a right angle bus bar connector 90 including a pair of resilient bus bar jaw contacts 80 extending from one side of a base tab 10 and a second pair of bus bar jaw contacts 80 extending from an end of the base tab 10, at a right angle to the first set of contacts 80. The bus bar connectors 88 and 90 allow in-line and perpendicularly positioned bus bars to be interconnected without the use of fasteners. Finally, FIG. 6*f* illustrates an offset meter jaw member 92 including a pair of meter jaw contacts 12 extending from one side of an extended base tab 94 and a pair of bus bar jaw contacts 80 extending from an opposite side of the base tab 94 in laterally spaced relation to the meter jaw contacts 12. The variations in the illustrated jaw members 3, 4, 70, 82, 86, and 92 and in the illustrated bus bar connectors 88 and 90 are not meant to be exhaustive, but as exemplary of the great flexibility of connectors embodying the present invention.

The meter jaw members 2 and bus bar jaw members 66 are preferably of a one-piece construction and are formed of a metal or metal allow having a high level of electrical and thermal conductivity. Because of similarities between the meter jaw members 2 and the bus bar jaw members 66, manufacturing details will be addressed particularly to the meter jaw members 2, but should be understood to also apply in most cases to the bus bar jaw members 66. Materials for the meter jaw members 2 should be strong and durable and have a selected degree of elasticity or resilience, particularly in the jaw contacts 12. Additionally, the material selected should be economical in bulk and economical to fabricate. Suitable materials for the meter jaw members 2 include aluminum alloys known by the standard designations of 6101, 6061 or 6063 alloys.

Figure 13:
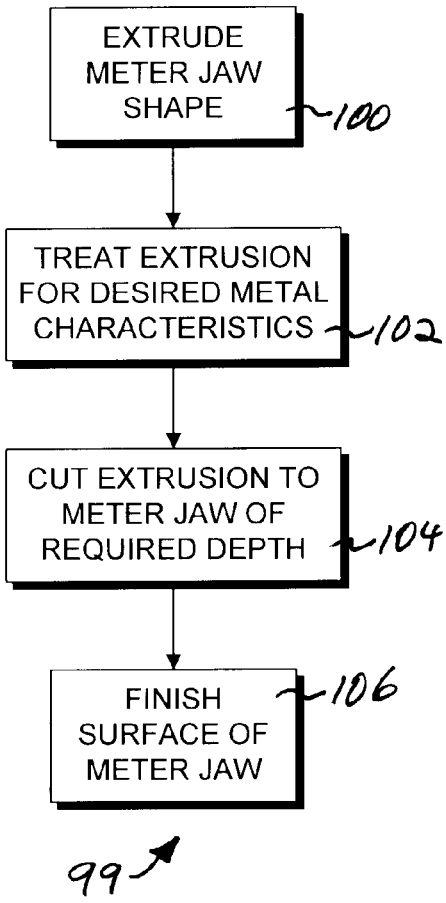
FIG. 13 is a flow diagram illustrating principal steps in forming meter jaws of the present invention by extrusion.

The meter jaw members 2 may be formed by any suitable manufacturing process which is appropriate for the selected material and the desired material characteristics for the elements of the meter jaw members 2. In certain embodiments, the meter jaw members 2 are formed by an extrusion process 99 (FIG. 13). In the process 99, the cross sectional shape of the meter jaw members 2 is extruded at step 100. The extrusion may be cut to selected lengths for convenient handling and for treating at step 102 for desired metal characteristics of the meter jaw members 2, including desired strength, hardness, stiffness, elasticity, and the like. Such treatments may include heat treating. The treated extrusion lengths are cut or sliced into the individual meter jaw members 2 having specific depths at step 104. Finally, surfaces of the meter jaw members 2 is finished at step 106, which may include deburring, polishing, chemical cleaning, and tinning or plating with other metals. As stated previously, the manufacturing processes described for the meter jaw members 2 are also appropriate for the alternative embodiments of the meter jaw members 72, 78, 86, and 92, as well as the bus bar jaw members 88 and 90.

Heat generated in the jaw member 2 is directly proportional to electrical resistivity and length and inversely proportional to cross sectional area. The slight improvement of aluminum to brass is coupled with the significant improvement in both length and cross-sectional area to result in a jaw with less than ⅕ the resistance of a conventional jaw. The heat conducted through the jaw 2 is directly proportional to thermal conductivity and the cross-sectional area and inversely proportional to the length. Typical values of prior art and the invention indicate that nearly four times as much heat can be conducted through the new jaw. The thermal gradient in the new jaw is less than ¼ that of a conventional jaw, or about 8 degrees centigrade less.

The unique attributes of the invention described herein allow better utilization of the trade-offs required to construct an economically feasible meter jaw. Aluminum costs far less per pound than either copper or copper alloys. Aluminum is also easily and economically extruded. Aluminum is regularly used in electrical connectors for these reasons. By using an extrusion process, it is possible to economically vary the thickness of the jaw contact fingers, permitting better mechanical, electrical and thermal performance. Aluminum is currently approximately ⅓ the density and ½ the price of copper or copper alloys. This results in a 6 to 1 cost advantage for this invention per unit volume.

Figure 1:
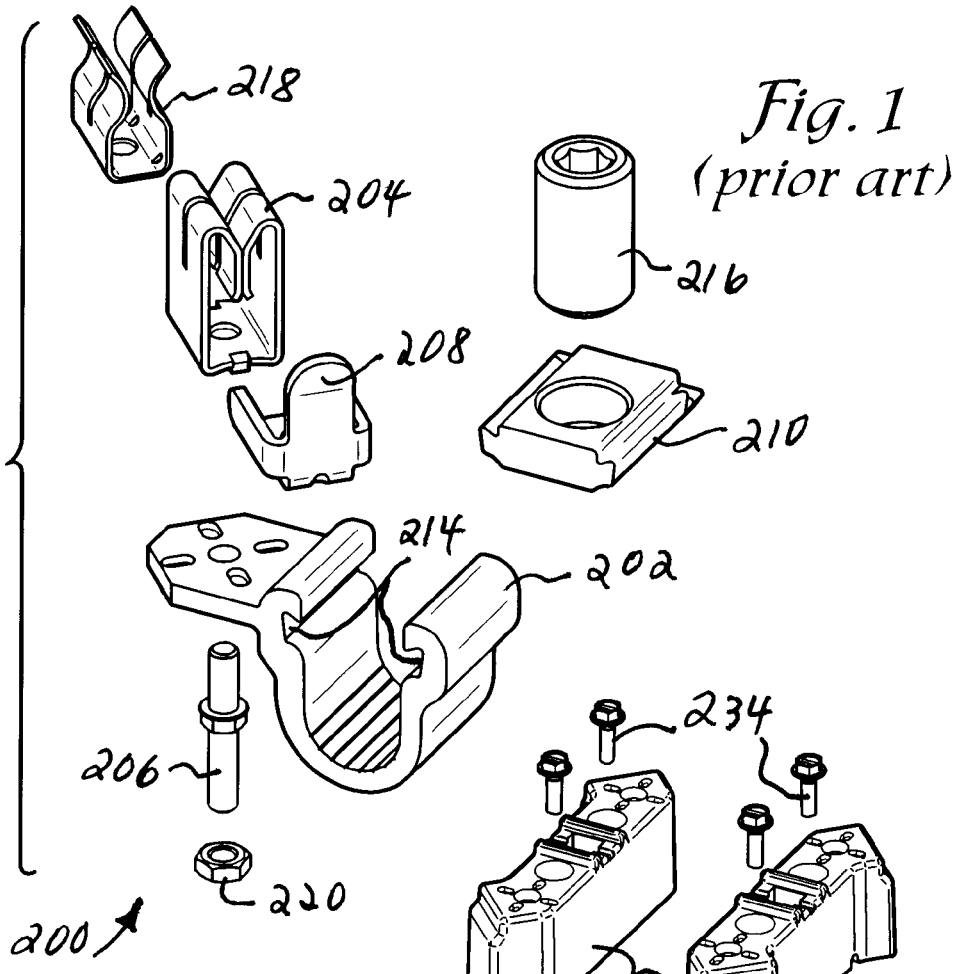
Fig. 1 (prior art)
FIG. 1 is an exploded perspective view of components of a prior art watt-hour meter socket jaw assembly.
Figure 7:
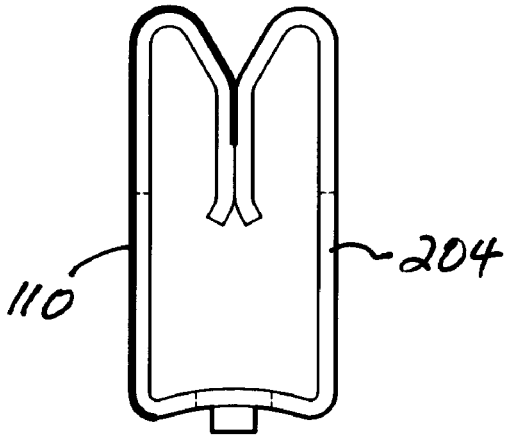
Fig. 7 (prior art)
FIG. 7 is an enlarged side elevational view of a prior art watt-hour meter socket jaw member and diagrammatically illustrates an effective electrical/thermal path of the jaw member.
Figure 8:
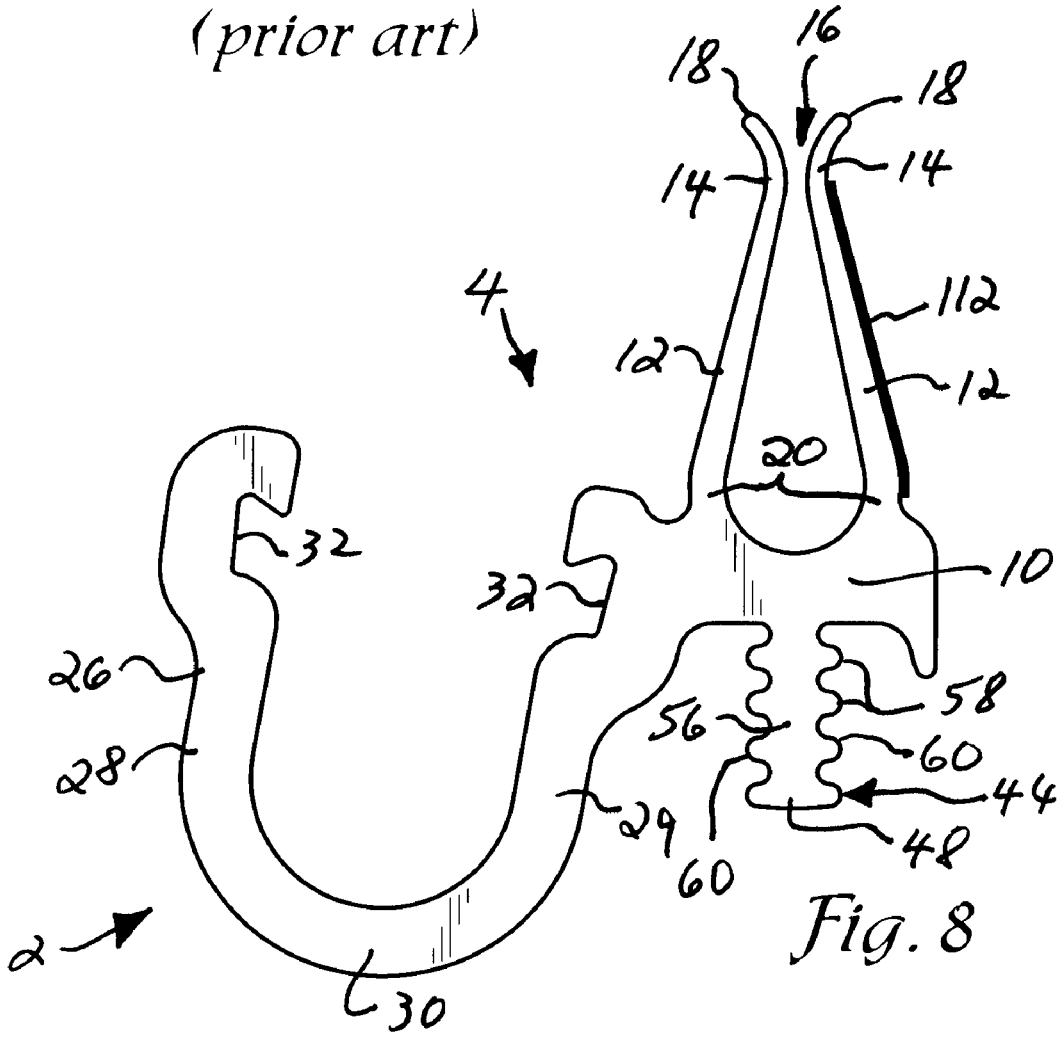
FIG. 8 is an enlarged side elevational view of the mold-in embodiment of the meter socket jaw member of the present invention and diagrammatically illustrates an effective electrical/thermal path of the mold-in jaw member.

FIGS. 7 and 8 diagrammatically illustrate a comparison of electrical and thermal conduction paths of a meter jaw assembly 2 according to the present invention with electrical and thermal conduction paths of a conventional meter jaw member 204, as previously shown in FIG. 1. Typical dimensions of the jaw member 204 are 0.75 inch (19.05 mm) wide by 0.047 inch (1.19 mm) thick, providing a cross sectional area of about 0.035 square inch (22.74 $mm^2$). The electrical and thermal conductive path 110 of the meter jaw member 204, represented by the heavy surface line in FIG. 7, extends from the area of contact of the jaw member 204 to the area of contact of the jaw member 204 with the wire connector 214 (FIG. 1) and has an effective length of 1.672 inches (42.47 mm) on each side of the meter jaw member 204. In contrast, a meter contact jaw 12 of the meter jaw member 2 has a width of 0.875 inch (22.23 mm) and a midpoint thickness of 0.074 inch (1.88 mm) for an average cross sectional area of about 0.065 square inch (41.77 $mm^2$). The effective length of electrical and thermal conductive path 112 for each jaw contact 12 of the jaw member 2 is 0.877 inch (22.28 mm). Thus, the jaw contacts 12 have a much greater cross sectional area and a much shorter path than a comparable portion of the conventional jaw members 204 to provide greater electrical conductivity and lower resistive heat generation while providing greater thermal conductivity for any heat generated by conduction or contact resistance between the meter blade and the jaw contacts 12.

Figure 9A:
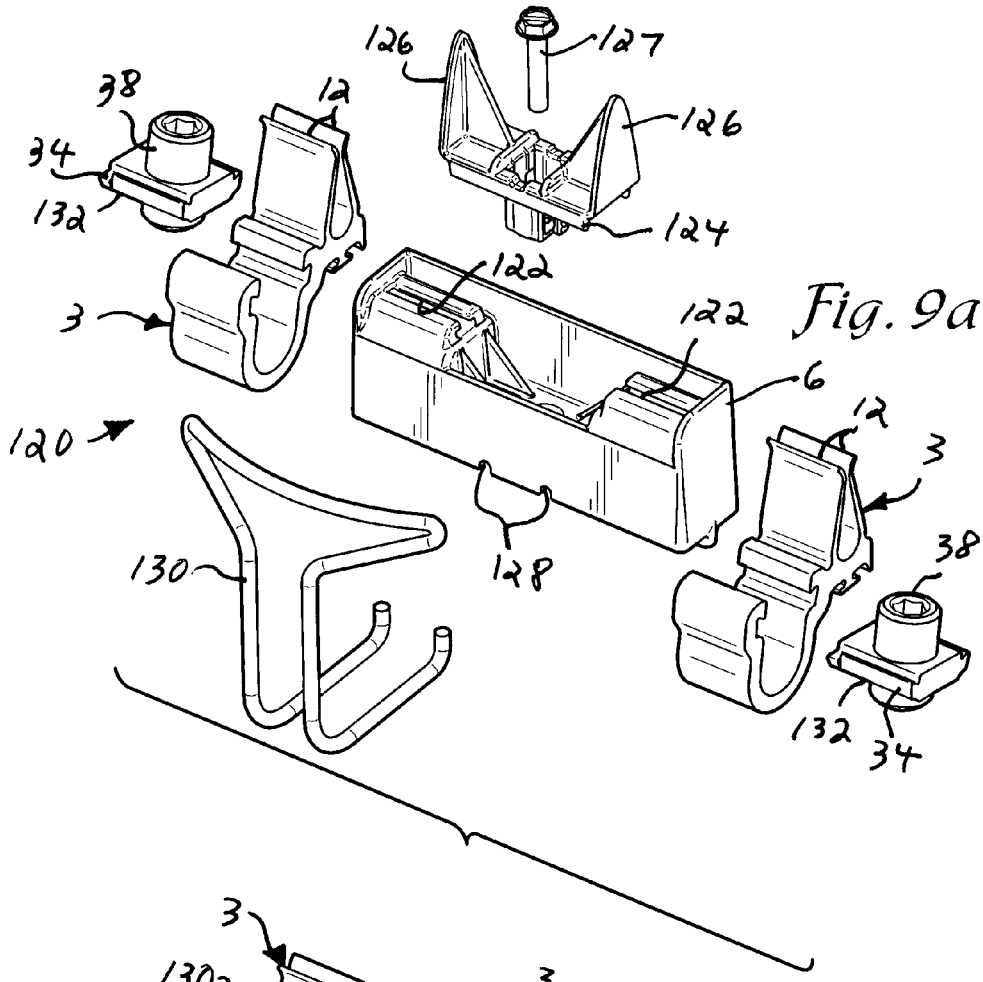
FIGS. 9*a* and 9*b* illustrate respectively an exploded perspective view of one side of a meter socket assembly and a perspective view of the assembled meter socket components, both incorporating the slide-in embodiment of the meter socket jaw of the present invention.
Figure 9B:
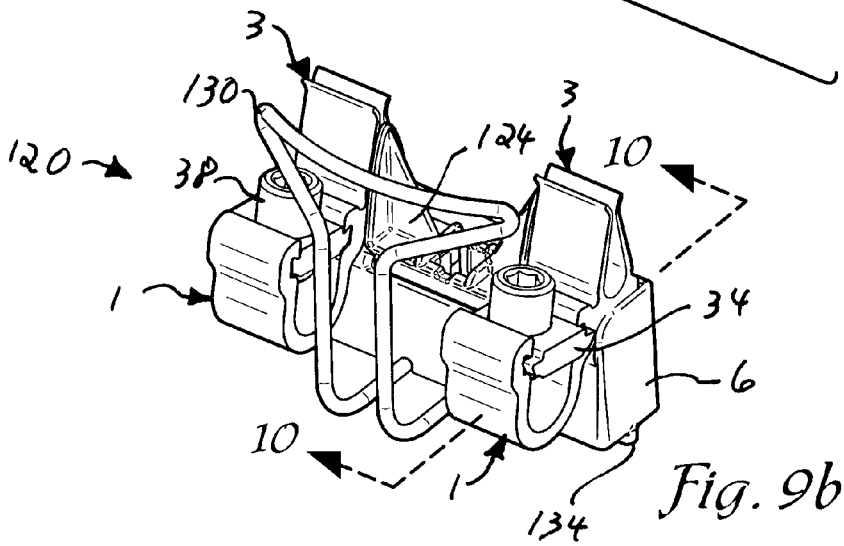
Figure 10:
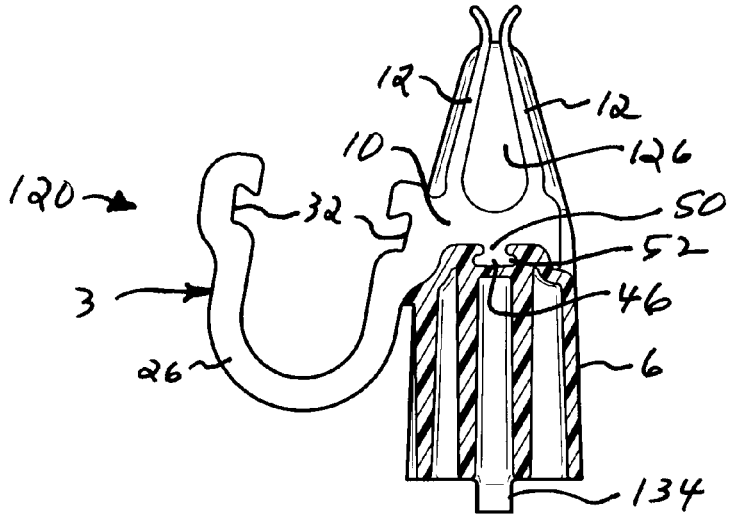
FIG. 10 is a cross-sectional view of the slide-in meter socket jaw within an insulative meter socket jaw mounting block, taken on line 10-10 of FIG. 9*b*.

FIGS. 9*a*, 9*b*, and 10 illustrate an embodiment of a slide-in meter socket assembly 120 that can utilize the one-piece slide-in meter jaw members 3. The insulative slide-in mounting block 6 has an aligned pair of open key slots or channels 122 that cooperate with the slide-in keys 46 of meter jaw members 3 to position the jaw members 3 on the mounting block 6. The illustrated key channels 122 are open toward the center of the mounting block 6 and closed toward the outer ends of the block 6. The jaw members 3 are retained in place by a jaw retainer 124 having gusseted guide plates 126 at its ends which engage the jaw contacts 12 of the jaw members 3 and also act as guides or position limits for the blades of the watt-hour meter when inserted. The retainer 124 is secured to the mounting block 6, as by a fastener 127 such as a screw or bolt. The illustrated retainer 124 has an essentially rectangular pocket feature that may receive an optional terminal to provide a ground reference for a meter blade when required. The mounting block 6 positions a pair of meter jaw members 3 in a spaced apart relation with the blade receiving spaces 16 thereof aligned to receive the aligned blades on one side of a conventional watt-hour meter.

Figure 2:
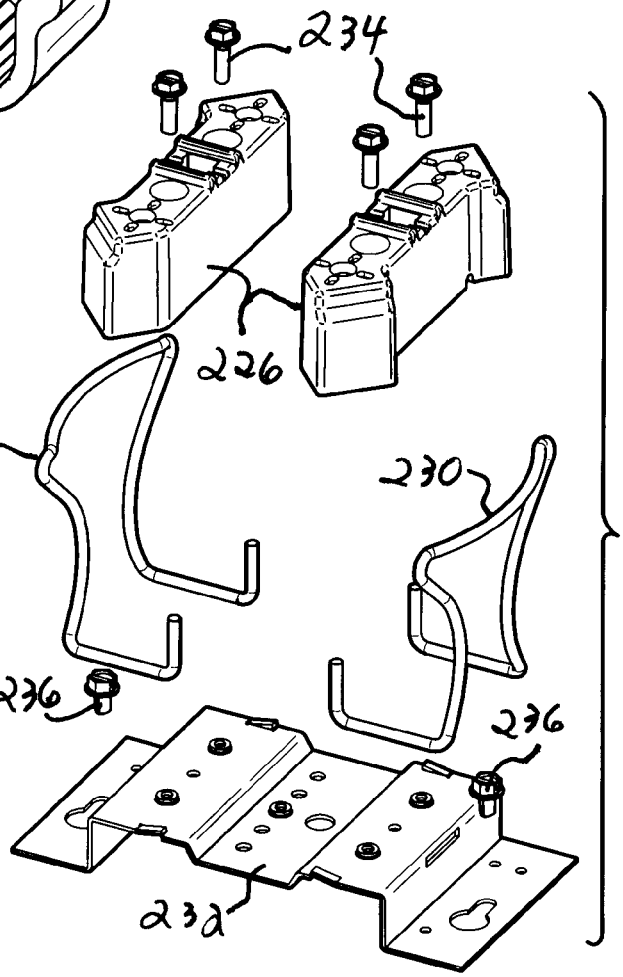
Fig. 2 (prior art)
FIG. 2 is an exploded perspective view of components of a prior art meter jaw mounting assembly.

The illustrated mounting block 6 includes grooves or notches 128 and apertures within bosses (not shown) on an underside of the block 6 to receive and properly position a wire meter support 130. Slide nut and slide nut screw assemblies 132, including a slide nut 34 and a slide screw 38, are then positioned in the receiving grooves 32 of meter jaw members 3 to engage and clamp stripped ends of power cables (not shown). Alternatively, a retainer/support member (not shown) could be configured which integrates the features and functions of the jaw retainer 124 and the meter support 130. A complete assembly 120, as shown in FIG. 9*b*, forms one half of a four terminal meter socket which is installed within a meter socket enclosure 228. The slide-in mounting block 6 may be formed from any suitable insulative material, such as from any one of a number of plastics, as by molding which is sturdy, stable, and highly insulative. The mounting block 6 may, for example, be formed of a glass fiber reinforced polycarbonate. The mounting block 6 may include sets of locating pegs 134 which engage holes in a mounting bridge 232 (FIG. 2) when the assembly 120 is installed within an enclosure 228.

Figure 11:
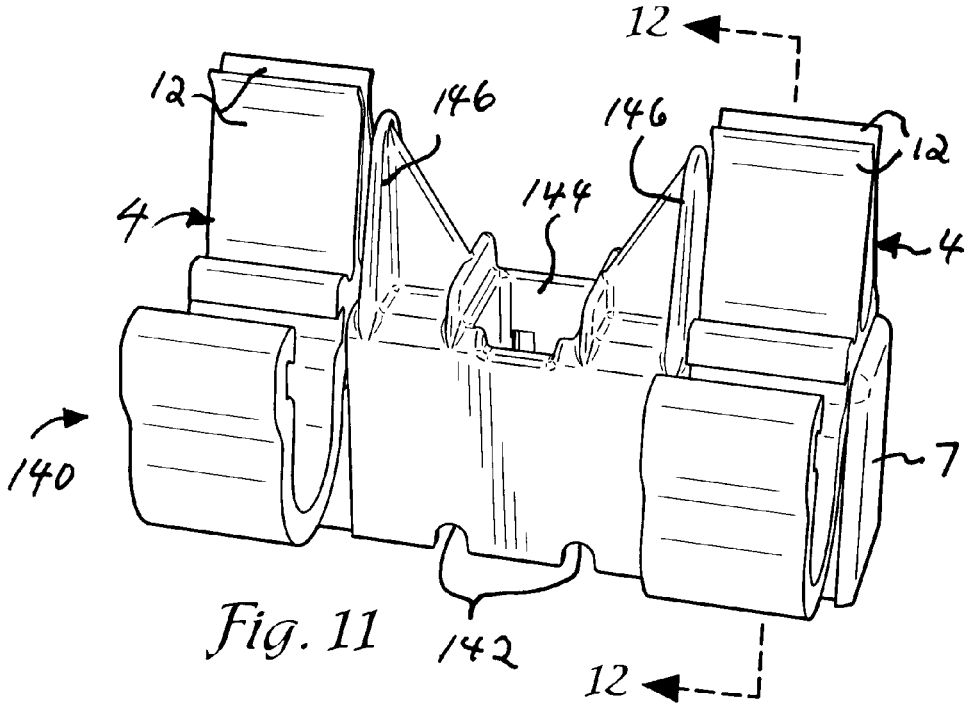
FIG. 11 is an enlarged perspective view of a meter socket half incorporating the mold-in embodiment of the meter socket jaw of the present invention.
Figure 12:
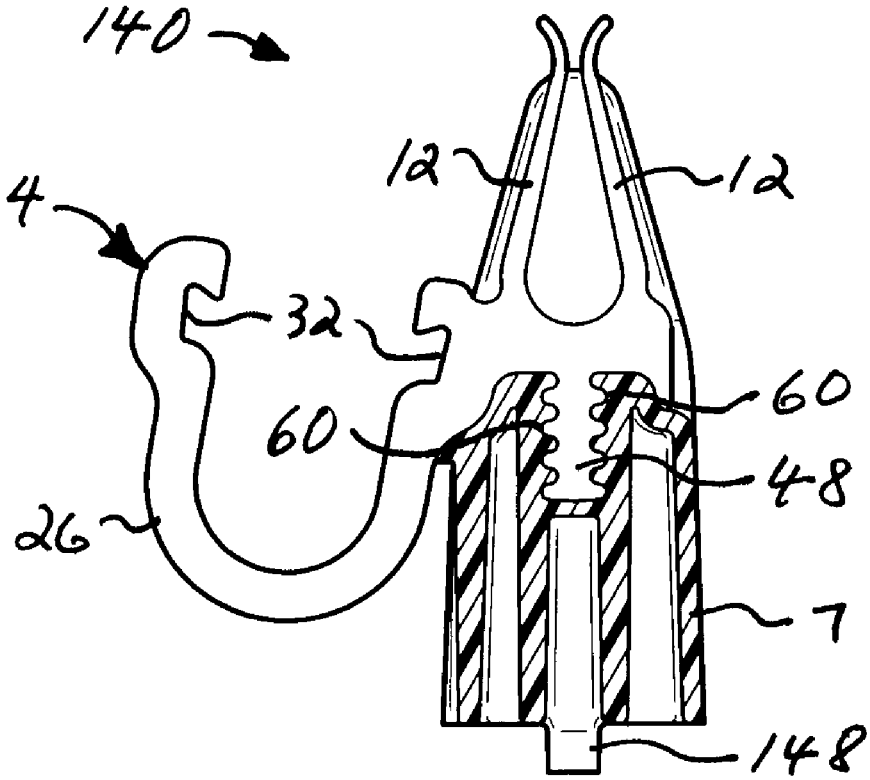
FIG. 12 is a cross sectional view of the mold-in meter socket jaw molded within an insulative meter socket jaw mounting block, taken on line 12-12 of FIG. 11.

FIGS. 11 and 12 illustrate an embodiment of a mold-in meter socket assembly 140 that can utilize the mold-in meter jaw member 4. The mold-in mounting block 7 has the meter jaw members 4 integrally molded thereinto and has notches 142 to receive and locate a wire meter support (not shown) similar to the support 130 of FIGS. 9*a* and 9*b*. The illustrated mounting block 7 has a centrally located pocket 144 including an aperture (not shown) to receive a mounting screw (not shown) similar to the mounting screw 127 of FIG. 9*a*. The pocket 144 is provided to receive an optional terminal (not shown) to provide a ground reference for a meter blade when required. The illustrated mold-in mounting block 7 includes integral meter blade guides 146 which are gusseted for reinforcement. The mounting block may also include locating pegs 148 (FIG. 12) The meter jaw members 4 are adapted to receive the slide nut and slide screw assemblies 132 within grooves 32 to secure the ends of power cables therein.

Figure 14:
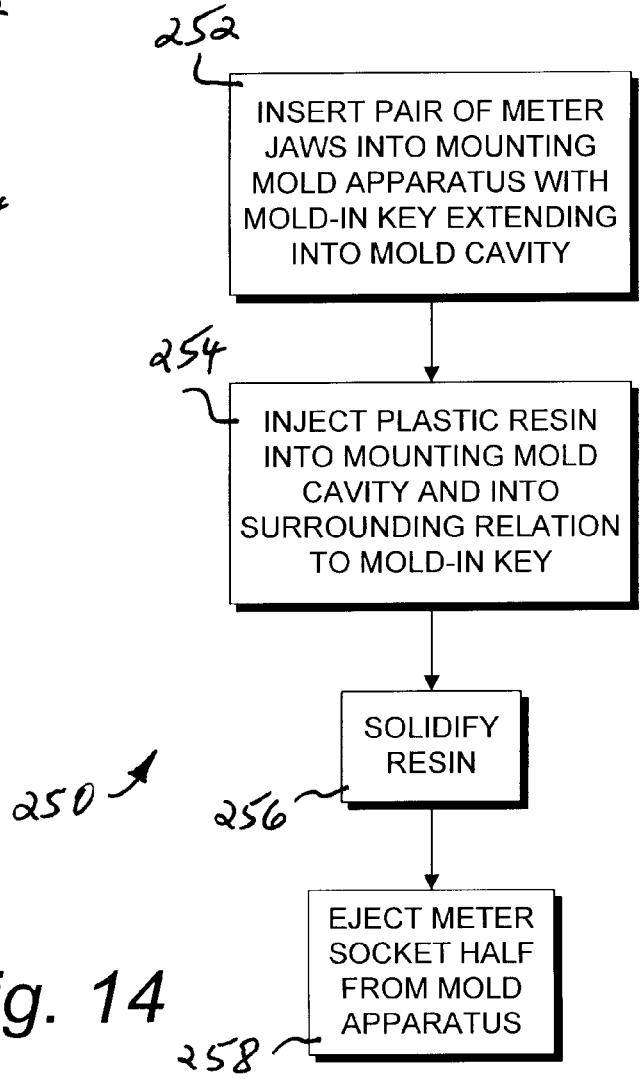
FIG. 14 is a flow diagram illustrating principal steps in forming a mold-in meter socket assembly of the present invention.

FIG. 14 illustrates a process 250 for forming the mold-in meter socket assembly 140. At step 252 a pair of mold-in meter jaw members 4 are inserted into a mounting mold apparatus (not shown) with the mold-in keys 48 thereof extending into the mold cavity having the shape of the mold-in mounting block 7. At step 254, a resin in a plastic state is injected into the mold cavity to fill the cavity and to surround the keys 48. The serrated surfaces 60 of the keys 48 helps to strongly retain the jaw members 4 in the mounting block 7. At step 256, the resin is solidified, as by cooling and/or curing. At step 258, a completed meter socket assembly 140 is ejected from the mold apparatus in a form similar to the assembly shown in FIG. 11. The mounting block 7 may be formed of materials similar to the mounting block 6, such as glass fiber reinforced polycarbonate. The mold-in assembly 140 greatly economizes assembly of a watt-hour meter socket by substantially reducing the part count and by automating assembly of the meter jaw block sub-assembly.

It is to be understood that while certain forms of the present invention have been illustrated and described herein, it is not to be limited to the specific forms or arrangement of parts described and shown.

What is claimed and desired to be secured by Letters Patent is:

1. A conductive one-piece meter jaw member for receiving a connector blade of a watt-hour meter and an electrical power conductor and comprising:

(a) a base tab;

(b) a pair of resilient meter jaw contacts extending from said base tab and having outer curved sections mutually curved toward one another, said jaw contacts being positioned in mutually spaced relation to form a meter connector blade receiving space between respective outer curved sections thereof;

(c) said jaw contacts having such geometric configurations and material characteristics as to exert a selected force on a meter connector blade having a specific thickness which is received in said blade receiving space; and (d) an electrical power connector extending from said base tab and selectively configured to receive said electrical power conductor.

2. A meter jaw member as set forth in claim 1 and including:

(a) said meter jaw contacts tapering from root ends thereof at said base tab toward free ends opposite said root ends to provide said meter jaw contacts with a selected degree of resilience.

3. A meter jaw member as set forth in claim 1 and including:

(a) a meter jaw mounting key extending from said base tab to enable securing said meter jaw member to a meter jaw mounting block.

4. A meter jaw member as set forth in claim 1 and including:

(a) a slide-in meter jaw mounting key extending from said base tab, said slide-in key being configured to enable slidably securing said meter jaw member to a slide-in meter jaw mounting block.

5. A meter jaw member as set forth in claim 1 and including:

(a) a mold-in meter jaw mounting key extending from said base tab, said mold-in key being configured to enable molding said key into a meter mounting block.

6. A meter jaw member as set forth in claim 1 and including:

(a) a U-shaped conductor receiver having spaced apart legs connected by a curved bight section, said conductor receiver being sized to receive an electrical power conductor therein.

7. A meter jaw member as set forth in claim 6 and including:

(a) a respective slide nut groove formed into opposite internal surfaces of said legs in mutually spaced to one another and in spaced relation to said bight section.

8. A meter jaw member as set forth in claim 7 in combination with:

(a) a slide nut slidably received in said slide nut grooves of said legs of said conductor receiver in spaced relation to said bight section, said slide nut having a threaded aperture formed therethrough; and (b) a slide screw received in said threaded aperture of said slide nut, said slide screw cooperating with said bight section of said conductor receiver to clamp a conductor therebetween within said conductor receiver.

9. A meter jaw member as set forth in claim 1 wherein said electrical power connector includes:

(a) a bus bar extending from said base tab.

10. A meter jaw member as set forth in claim 1 wherein said electrical power connector includes:

(a) a bus bar receiving jaw extending from said base tab and configured to receive a bus bar therein.

11. A meter jaw member as set forth in claim 1 wherein said electrical power connector includes:

(a) a bus bar receiving jaw extending from said base tab; and (b) a pair of resilient S-shaped meter jaw contacts extending from said base tab, said jaw contacts being positioned in mutually spaced, back-to-back relation to form a bus bar receiving spaced between respective outer curved sections thereof.

12. A meter jaw member as set forth in claim 1 wherein:

(a) said meter jaw member is formed of a metal alloy as an extrusion which is subsequently cut to a selected depth.

13. A conductive one-piece meter jaw member for receiving a connector blade of a watt-hour meter and an electrical power conductor and comprising:

(a) a U-shaped conductor receiver having spaced apart legs connected by a curved bight section, said conductor receiver being sized to receive an electrical power conductor;

(b) a respective slide nut groove formed into opposite internal surfaces of said legs in mutually spaced to one another and in spaced relation to said bight section;

(c) a base tab extending from an external surface of one of said legs;

(d) a pair of resilient, generally S-shaped meter jaw contacts extending from said base tab, said jaw contacts being positioned in mutually spaced, back-to-back relation to form a meter connector blade receiving space between respective outer curved sections thereof; and (e) said jaw contacts having such geometric configurations and material characteristics as to exert a selected force on a meter connector blade having a specific thickness which is received in said blade receiving space.

14. A meter jaw member as set forth in claim 13 and including:

(a) said meter jaw contacts tapering from root ends thereof at said base tab toward free ends opposite said root ends to provide said meter jaw contacts with a selected degree of resilience.

15. A meter jaw member as set forth in claim 13 and including:

(a) a meter jaw mounting key extending from said base tab to enable securing said meter jaw member to a meter jaw mounting block.

16. A meter jaw member as set forth in claim 13 and including:

(a) a mold-in meter jaw mounting key extending from said base tab, said mold-in key being configured to enable molding said key into a meter mounting block.

17. A meter jaw member as set forth in claim 16 wherein said mold-in meter jaw mounting key includes:

(a) a key web extending from said base tab having opposite sides; and (b) a plurality of key flanges extending from said opposite sides of said key web in spaced relation therealong to form opposite, substantially serrated surfaces on said opposite sides of said key web.

18. A meter jaw member as set forth in claim 13 and including:

(a) a slide-in meter jaw mounting key extending from said base tab, said slide-in key being configured to enable slidably securing said meter jaw member to a slide-in meter jaw mounting block.

19. A meter jaw member as set forth in claim 18 wherein said slide-in meter jaw mounting key includes:

(a) a key web extending from said base tab; and (b) said key web terminating in a key flange spaced from said base tab.

20. A jaw member as set forth in claim 13 in combination with:

(a) a slide nut slidably received in said slide nut grooves of said legs of said conductor receiver in spaced relation to said bight section, said slide nut having a threaded aperture formed therethrough; and (b) a slide screw received in said threaded aperture of said slide nut, said slide screw cooperating with said bight section of said conductor receiver to clamp a conductor therebetween within said conductor receiver.

* * * * *